US011313100B2

(12) United States Patent
Putz

(10) Patent No.: US 11,313,100 B2
(45) Date of Patent: Apr. 26, 2022

(54) HYDRAULIC SYSTEM FOR A VEHICLE AS WELL AS A VEHICLE WITH SUCH A HYDRAULIC SYSTEM

(71) Applicant: SYN TRAC GmbH, Bad Goisern (AT)

(72) Inventor: Stefan Putz, Bad Goisern (AT)

(73) Assignee: SYN TRAC GmbH, Bad Goisern (AT)

( * ) Notice: Subject to any disclaimer, the term of this patent is extended or adjusted under 35 U.S.C. 154(b) by 0 days.

(21) Appl. No.: 16/870,519

(22) Filed: May 8, 2020

(65) Prior Publication Data

US 2020/0270840 A1 Aug. 27, 2020

Related U.S. Application Data

(63) Continuation of application No. PCT/EP2018/080819, filed on Nov. 9, 2018.

(30) Foreign Application Priority Data

Nov. 10, 2017 (DE) ..... 10 2017 126 505.8

(51) Int. Cl.
*E02F 9/22* (2006.01)
*E02F 3/36* (2006.01)
(Continued)

(52) U.S. Cl.
CPC ..... *E02F 3/3654* (2013.01); *E02F 3/3663* (2013.01); *E02F 9/225* (2013.01);
(Continued)

(58) Field of Classification Search
CPC ..... E02F 3/3654; E02F 9/2232; E02F 3/3663; E02F 9/225; E02F 9/2292; E02F 9/2296;
(Continued)

(56) References Cited

U.S. PATENT DOCUMENTS 4,033,127 A * 7/1977 Amstutz ..... E02F 9/2239 60/455
4,335,577 A 6/1982 Lobmeyer et al.
(Continued)

FOREIGN PATENT DOCUMENTS

DE 202011106833 U1 * 2/2012 ..... A01B 59/063
EP 1812715 A2 8/2007
(Continued)

OTHER PUBLICATIONS

International Search Report for International Application No. PCT/EP2018/080819 dated Feb. 20, 2019.

*Primary Examiner* — Thomas E Lazo
(74) *Attorney, Agent, or Firm* — Stephen J. Kenny; Foley Hoag, LLP

(57) ABSTRACT

Hydraulic system (120) for a vehicle comprising a vehicle hydraulic circuit (122) among others for the hydraulic supply of connecting means of an automatic coupling means, wherein the connecting means is designed to connect a coupling means (31) of the vehicle with a correspondingly designed coupling means (32) of an add-on unit and an operating hydraulic circuit (121) for supplying at least one Power-Beyond coupling, wherein the vehicle hydraulic circuit and the operating hydraulic circuit are designed independent of one another and each having a hydraulic pump.

14 Claims, 8 Drawing Sheets

(51) Int. Cl.
*F04D 13/02* (2006.01)
*F15B 11/16* (2006.01)

(52) U.S. Cl.
CPC ..... *E02F 9/2232* (2013.01); *E02F 9/2292* (2013.01); *E02F 9/2296* (2013.01); *F04D 13/02* (2013.01); *F15B 11/161* (2013.01); *F15B 2211/20523* (2013.01); *F15B 2211/20546* (2013.01); *F15B 2211/7053* (2013.01); *F15B 2211/71* (2013.01)

(58) Field of Classification Search
CPC ..... F04D 13/02; F15B 11/161; F15B 2211/205823; F15B 2211/20546; F15B 2211/7053; F15B 2211/71; B62D 5/063; B62D 5/064; B62D 63/061; B62D 27/06
See application file for complete search history.

(56) References Cited

U.S. PATENT DOCUMENTS 4,609,330 A * 9/1986 Fahey ..... F15B 11/17 417/288
4,685,527 A * 8/1987 Oswald ..... B62D 59/04 180/14.2
6,018,895 A * 2/2000 Duppong ..... E02F 3/325 37/348
6,134,887 A * 10/2000 Bertotti ..... E02F 9/2225 60/422
7,201,106 B2 * 4/2007 Whiston ..... B60F 1/043 105/72.2
8,160,785 B2 * 4/2012 Kahle ..... E02F 3/3654 701/50
9,394,894 B2 * 7/2016 Fedde ..... A01B 59/00
9,764,778 B2 * 9/2017 Scharmuller ..... A01B 71/063
2008/0202110 A1 8/2008 Keuper et al.
2013/0312401 A1 * 11/2013 Frommelt ..... B62D 5/30 60/459
2014/0294622 A1 10/2014 Fedde
2016/0052563 A1 2/2016 Scharmuller et al.
2017/0314578 A1 * 11/2017 Knobloch ..... E02F 9/2235
2020/0270840 A1 8/2020 Putz

FOREIGN PATENT DOCUMENTS

EP 2784223 A2 10/2014
JP 2012/172687 A 9/2012
JP 57-59801 B2 8/2015

* cited by examiner

HYDRAULIC SYSTEM FOR A VEHICLE AS WELL AS A VEHICLE WITH SUCH A HYDRAULIC SYSTEM

CROSS-REFERENCE TO RELATED APPLICATIONS

This application is a Continuation of and claims the benefit of priority under 35 USC 120 to PCT/EP2018/080819 filed Nov. 9, 2018, which claims priority to DE 10 2017 126 505.8 filed Nov. 10, 2017, the entire contents of each are hereby incorporated by reference.

The present disclosure concerns a hydraulic system for a vehicle as well as a vehicle with such a hydraulic system.

Hydraulic systems are provided in commercial vehicles and towing vehicles, in order to lift, propel or to control. In the case of tractors, hydraulic systems for power lift packages with position controllers can be provided for the work equipment or for steering hydraulics. Hydrostatic traction drive and operating drive of forest machinery are operated by hydraulic systems likewise. In commercial vehicles, hydraulic systems are provided for tipping hydraulics, for tail lifts, for steering assistance (power steering), for clutch and brake actuation and, for example, for hydrostatic traction drives.

From EP 2 784 223 A2 a vehicle with an add-on unit coupling and an add-on unit for this are known. In this vehicle a load-controlled hydraulic pump is present which runs continuously with an engine of the vehicle and which receives hydraulic fluid from a reservoir and delivers it to a high-pressure section, wherein an add-on unit is supplied with hydraulic fluid or energy via a Power-Beyond connection. To depressurise the Power-Beyond connection, in case of doubt, a shut-off valve is provided for the Power-Beyond connection.

From the EP 1 812 715 B1 a hydraulic control arrangement is known. This comprises a pump that can, for example, supply several consumers with a pressure medium, wherein the control arrangement comprises a Power-Beyond connection to which at least one Power-Beyond consumer can be connected, wherein the setting of the input pressure compensator is done as a function of the largest of the load pressures of the consumers, the pump is a pump with an adjustable delivery volume that can be controlled depending on the setting of the input pressure compensator.

A quick coupling system for add-on unit and in particular for agricultural add-on unit is known from DE 20 2011 106 833 U1. From this document it is known that the mechanical coupling between a built-in unit and an agricultural vehicle can be automated to a large extent by using a three-point mount, wherein electrical, electronic or fluidic connections are also established after a mechanical coupling using movable coupling plates is done.

In coupling mechanisms or coupling methods between an agricultural vehicle and an add-on unit known in the prior art, it is absolutely essential to switch off the engine for coupling, so that the hydraulic pumps are depressurised. Failing which, the hydraulic connections cannot be connected to each other, as too much resistance would be generated on application of the working pressure and also the couplings would get damaged. Therefore, in the prior art in the previously mentioned automatic coupling, the mechanical coupling is first effected and after the mechanical coupling is brought about, which requires a lot of effort, the engine is switched off and the fluidic coupling takes place in a second step.

SUMMARY OF THE DISCLOSED SUBJECT MATTER

The object of the present disclosure is to provide an improved hydraulic system for a vehicle which has a high level of operational reliability and an improved efficiency. The object is achieved with the features of claim 1. Advantageous further embodiments are characterized in the dependent claims.

It is a further object of the disclosure to provide a method for operating a hydraulic system for a vehicle, with which a high level of operational reliability, simplified coupling and improved efficiency can be achieved.

It is also an object of the disclosure to provide a vehicle with such a hydraulic system, which has a high level of operational reliability and an improved efficiency in the hydraulic circuit.

According to the disclosure, a hydraulic system for a vehicle is provided, which comprises a vehicle hydraulic circuit, among others, for the hydraulic supply of connecting means of a coupling means, and also comprises an operating hydraulic circuit for supplying at least one Power-Beyond coupling, wherein the vehicle hydraulic circuit and the operating hydraulic circuit is designed independent of one another and each has its own hydraulic pump.

The advantage here is that the vehicle hydraulic circuit is used on the one hand to establish the coupling between the vehicle and an add-on unit and to ensure that the vehicle is steered and the hydro pneumatic suspension can be operated to regulate the level. This is important because the vehicle is to be steered and also raised or lowered during the connection and coupling process in order to match the level of add-on unit with the level of the vehicle.

In contrast to the prior art, in which only one hydraulic pump is employed and the Power-Beyond connection is controlled by a valve, the design according to the disclosure enables considerably higher performance and a significantly improved efficiency. The design according to the disclosure with a second hydraulic pump for the working circuit enables the Power-Beyond coupling to be optimally pressurised with the hydraulic fluid, so that operation is possible without significant pressure loss. Existing valves in the prior art limit the flow and thereby reduce the output or increase it to such an extent that their proper installation is not possible. In this way, a Power-Beyond coupling can be coupled approximately without pressure at a Stand-by-pressure of approximately 20 bar.

The vehicle according to the disclosure comprises a coupling means for connecting the vehicle to a correspondingly designed coupling means of an add-on unit and a vehicle hydraulic circuit for the hydraulic supply of connecting means, wherein the connecting means is designed to connect a coupling means of the vehicle with a correspondingly designed coupling means of an add-on unit and an operating hydraulic circuit for supplying at least one Power-Beyond coupling, wherein the vehicle hydraulic circuit and the operating hydraulic circuit is designed independent of one another and each having a hydraulic pump. In this way, at least one Power-Beyond coupling can be coupled almost pressurelessly at a standby pressure of approximately 20 bar.

According to the disclosure, it is evident that if connecting means of a coupling means and at least one Power-Beyond coupling are supplied by a common hydraulic pump during a coupling process, a load pressure in a feed hook cylinder activates the pump via a load signalling line. Thereby, Power-Beyond coupling is also pressurized during the coupling process. This could damage the Power-Beyond coupling during the coupling process since it cannot be switched off. Alternatively, an additional valve, which needs to be very large due to the high pump output and/or would generate additional pressure losses, in turn contradicting the basic idea of the Power-Beyond systems.

In an embodiment of the vehicle hydraulic system according to the disclosure, in addition to the docking valve block, the vehicle hydraulic pump also supplies to the axle steering and in particular a rear axle steering and a hydro pneumatic suspension of a chassis. This enables the vehicle to be steered during the coupling process and, in addition, raise and lower the vehicle with respect to the level of the on-site coupling means in order to match the coupling elements.

Another important advantage is the clear separation of safety-critical functions, e.g. a rear axle steering and suspension on the one hand and the operating hydraulics on the other. The docking valve block is in any case not active when the vehicle is in operation and cannot influence the suspension and steering.

A coupling plate on the add-on unit end is connected to the vehicle coupling plate by pulling in a docking plug-in module by means of the corresponding pull-in hooks in a docking receiver. The hydraulic supply to the feed hooks are supplied by a vehicle hydraulic circuit. An operating hydraulic pump arranged on the vehicle is in stand-by mode during the coupling process between docking receiver and docking plug-in module. This enables the almost pressure-free (Stand-By pressure approx. 20 bar) coupling of Power-Beyond couplings.

The concept according to the disclosure is advantageous in that an isolation valve between the Power-Beyond coupling and the operating hydraulic pump is no longer required, since this valve would either have to be very large or would generate large pressure losses, which contradicts the meaning of a Power-Beyond connection. This means, in coupling devices known from the prior art, it is absolutely necessary to switch off the engine when coupling, so that the hydraulic pumps are depressurized. Failing which, the hydraulic connections cannot be connected to each other, as too much resistance would be generated on application of the working pressure.

A significant advantage of the disclosure compared to the prior art is that the mechanical coupling of the add-on unit and the fluidic coupling of the add-on unit can be effected simultaneously by the two separate hydraulic circuits, since the hydraulic circuit for the add-on unit is depressurized so that there is no damage to the couplings. It is also advantageous that the vehicle hydraulic circuit is available for any necessary vehicle corrections by steering movements or upward and downward movements, for a significantly improved coupling process on the whole.

According to the disclosure, two independent hydraulic circuits, namely on the one hand, a vehicle hydraulic circuit and on the other hand, an operating hydraulic circuit. Furthermore, in the coupling according to the disclosure, the engine runs in order to enable coupling a vehicle and its docking receiver correspondingly into a docking slot of an add-on unit.

A feature or features of any aspect of the disclosure described herein may be combined in some embodiments with any feature or features of any other aspect of the disclosure described herein.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION OF AN EXEMPLARY EMBODIMENT

Figure 1:
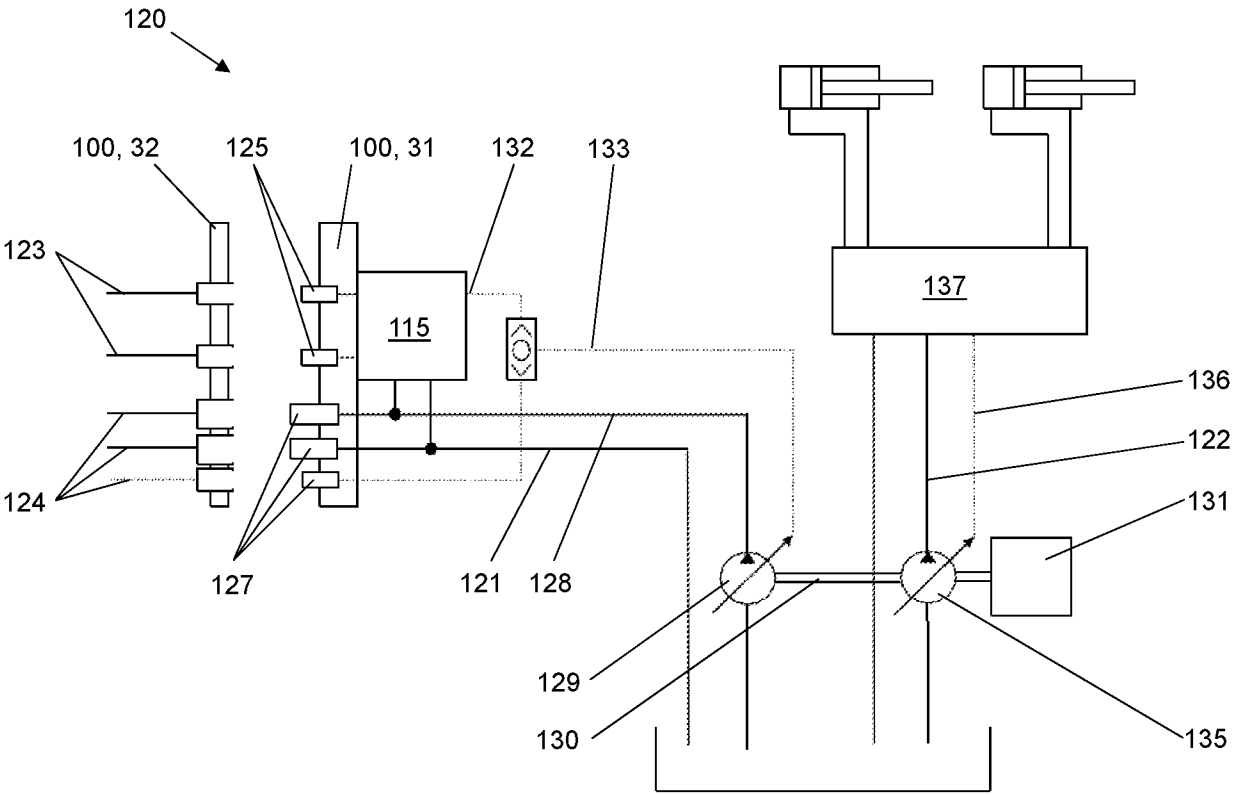
FIG. 1: a schematic view of a hydraulic system according to the disclosure.

According to the disclosure, a hydraulic system 120 is provided for a vehicle. The hydraulic system 120 comprises an operating hydraulic circuit 121 and a vehicle hydraulic circuit 122 which is formed independent of it. A vehicle equipped with it comprises a coupling means for connecting the vehicle to a correspondingly designed coupling means of an add-on unit.

The coupling means of the vehicle is a docking receiver 31 and the coupling means of the add-on unit is a docking receiver 32. This is described in detail below. Coupling bushings 123 of an operating hydraulic control circuit on the add-on unit and coupling bushings 124 of a Power-Beyond connection on the add-on unit are arranged on the docking plugin module 32. The docking receiver 31 of the vehicle has corresponding coupling connector 125 of an operating hydraulic control circuit 126 on the vehicle, which are coupled to a valve block 115.

Furthermore, coupling connectors 127 are provided on the docking receiver 31 for the Power-Beyond connection. The coupling connector 127 for the Power-Beyond connection are connected via lines 128 to a variable displacement pump of the hydraulic circuit or an operating hydraulic pump 129. This operating hydraulic pump 129 is inseparably connected to a crankshaft 130 of an engine 131 and is supplied with the energy necessary for operation. The operating hydraulic pump 129 is controlled by a load signalling controller 132 via a corresponding load signalling line 133. The vehicle hydraulic circuit 122 is designed independent of the operating hydraulic circuit 121.

The vehicle hydraulic circuit 122 likewise comprises a vehicle hydraulic pump 135, which is also designed as a variable displacement pump and is connected to a valve block 137 of the docking system via an additional load signalling line 136. This vehicle hydraulic pump 135 is inseparably connected to a crankshaft 130 of an engine 131 and is supplied with the energy necessary for operation. The vehicle hydraulic pump 135 is connected via at least one hydraulic line to a valve block for actuating cylinders for the feed hooks or catch hooks of the docking receiver 31 and a locking device. Power-Beyond connections are used for add-on units that have their own hydraulic system, hydraulic control or regulation system. They need a supply line, a tank line and a load signalling line from a tractor with a load-sensing unit.

The following devices must be operated via coupling plates and must be connected to each other:

double-acting cylinder
double-acting cylinder with load switch
double-acting hoist
single-acting cylinder, for example tipper
Hydraulic motor on controller
Valve block on Power-Beyond connection
Hydraulic motor on Power-Beyond connection.

The vehicle hydraulic pump takes care of the feed hook and catch hook of the docking receiver and the locking.

Figure 2:
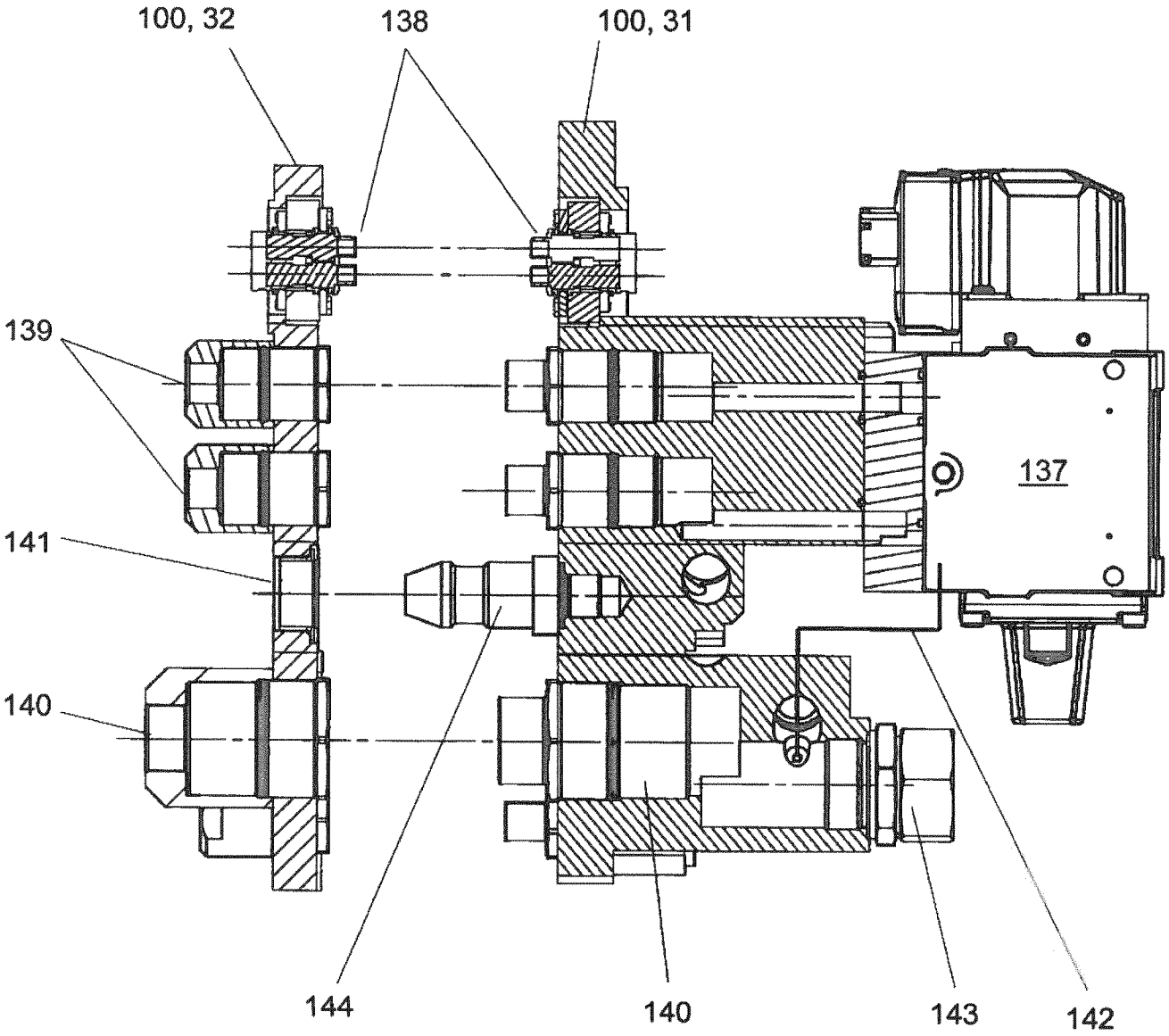
FIG. 2: a side view of two coupling plates with a valve block.
Figure 4:
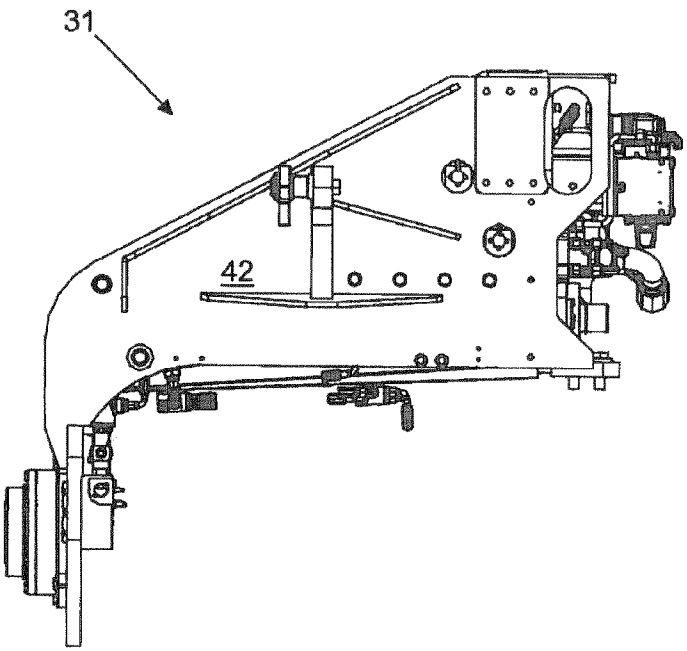
FIG. 4: a side plan view of the docking receiver.
Figure 3:
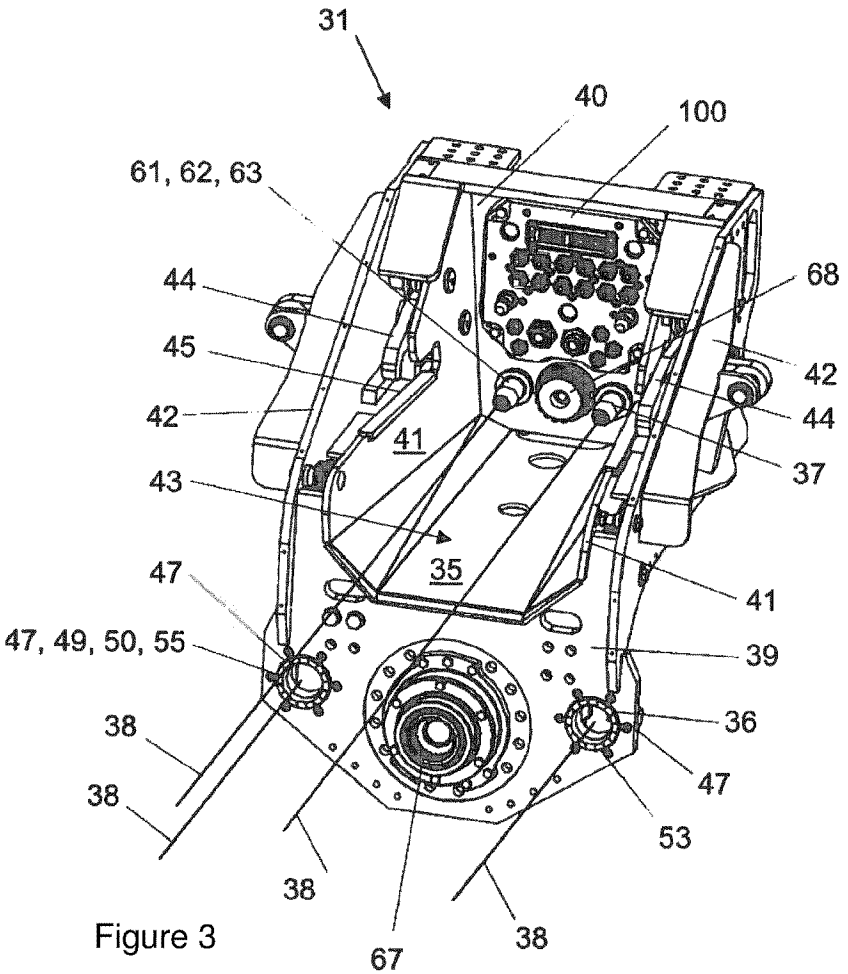
FIG. 3: a perspective view of a docking receiver.
Figure 6:
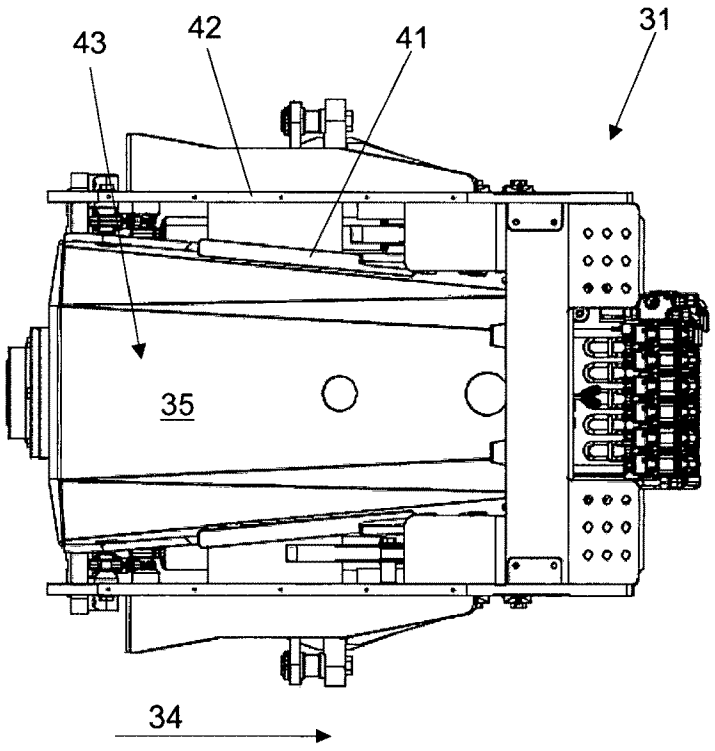
FIG. 6: a plan view of the docking receiver from top.
Figure 5:
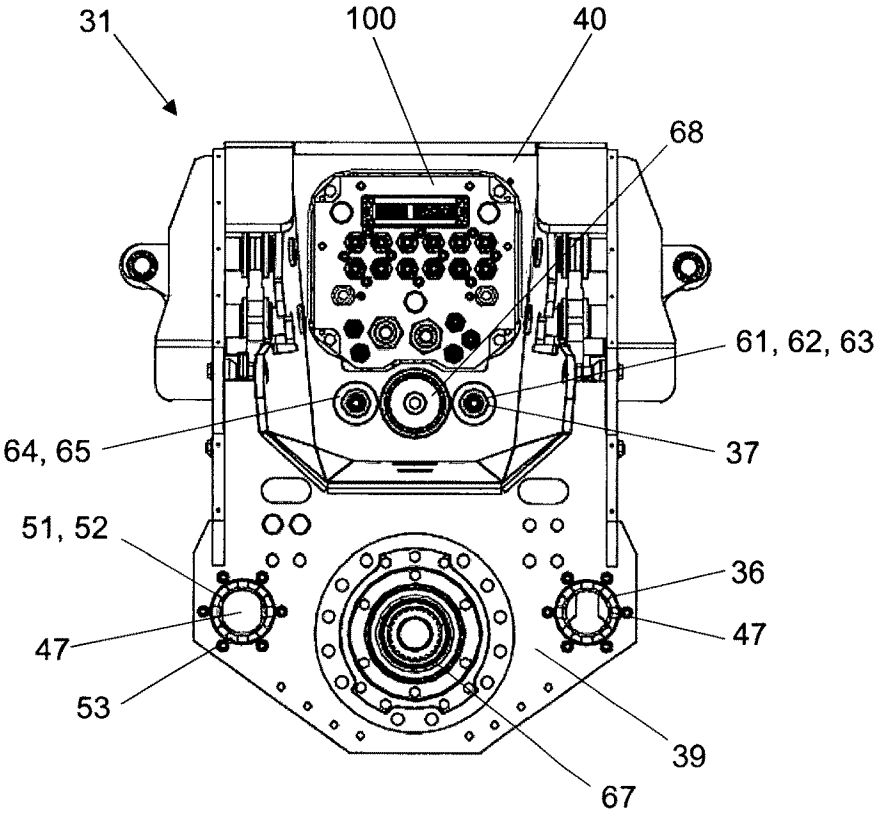
FIG. 5: a plan view of the docking receiver from the front.
Figure 8:
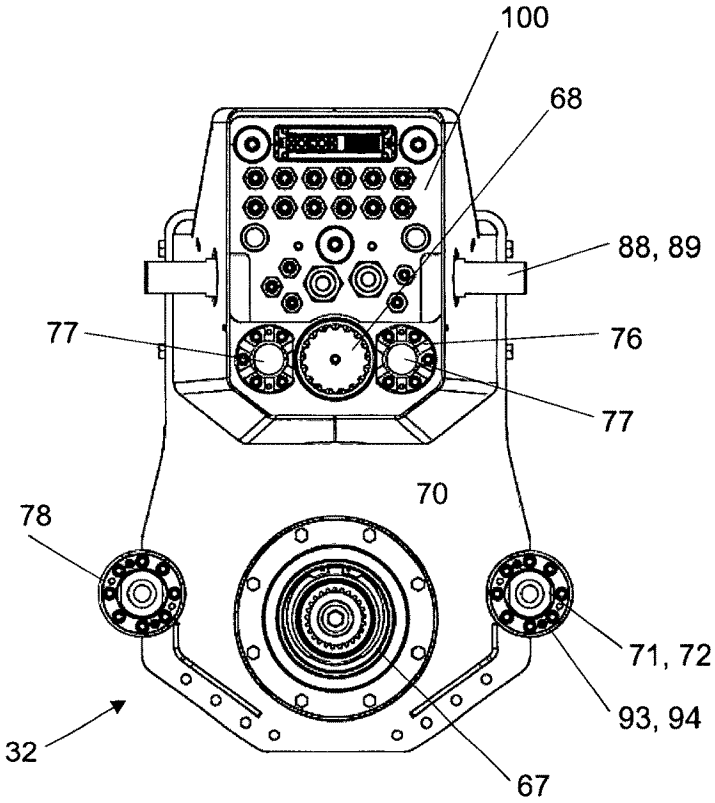
FIG. 8: a plan view of the docking plug-in module from the front.
Figure 7:
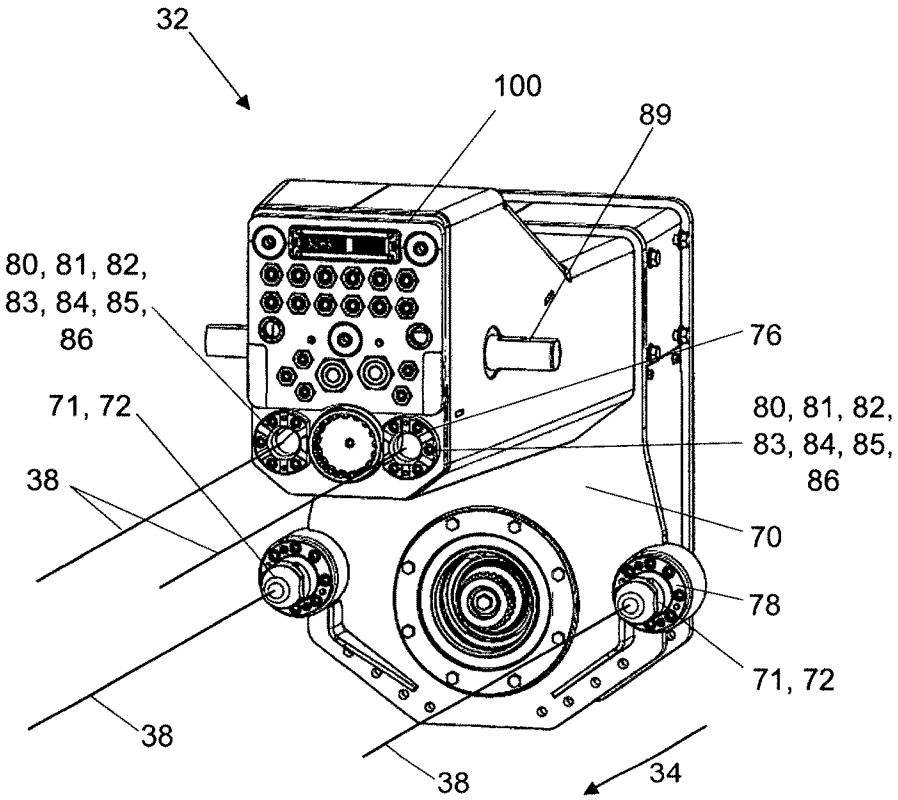
FIG. 7: a perspective view of a docking plug-in module.
Figure 10:
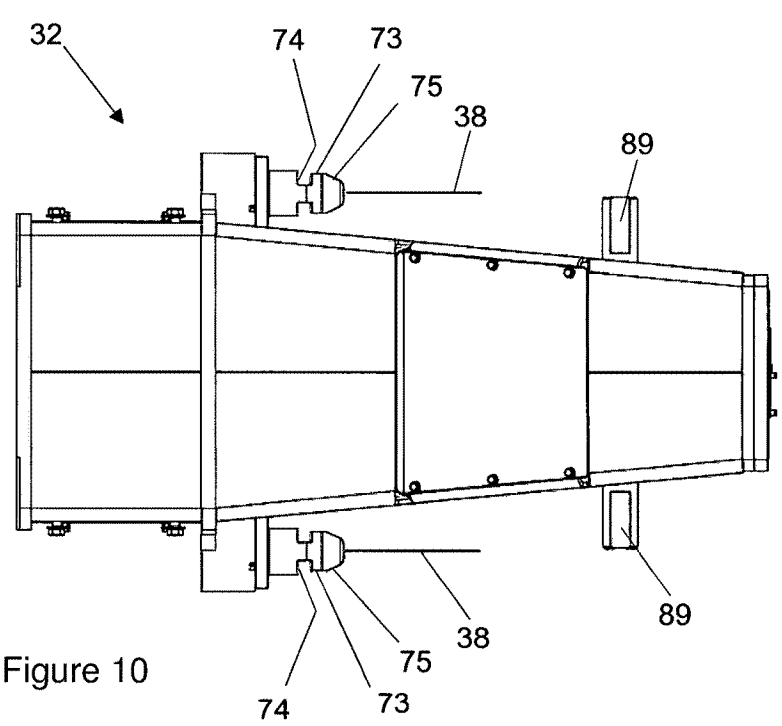
FIG. 10: a plan view of the docking plug-in module from top.
Figure 9:
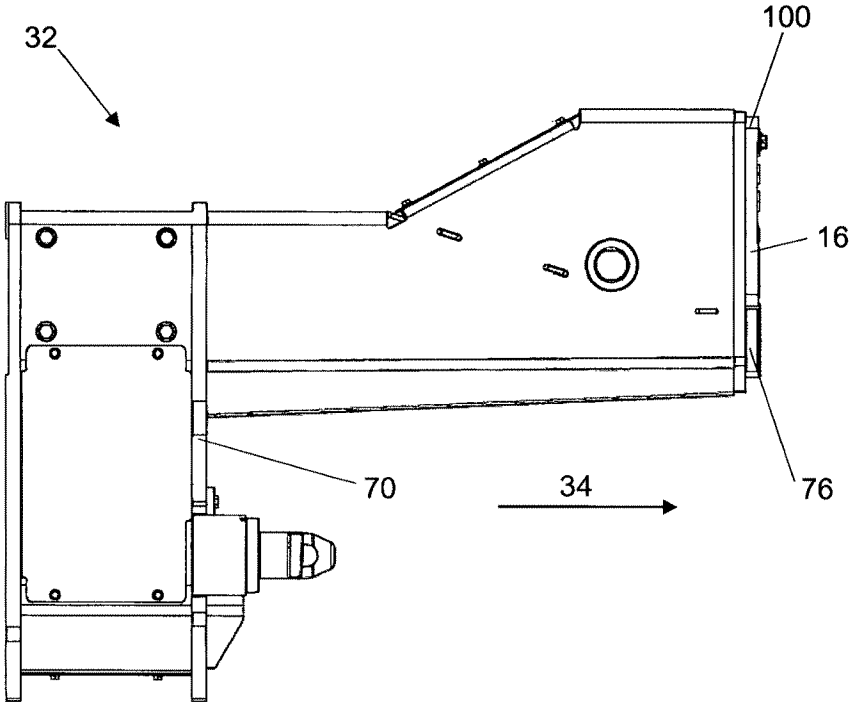
FIG. 9: a side plan view of the docking plug-in module.
Figure 12:
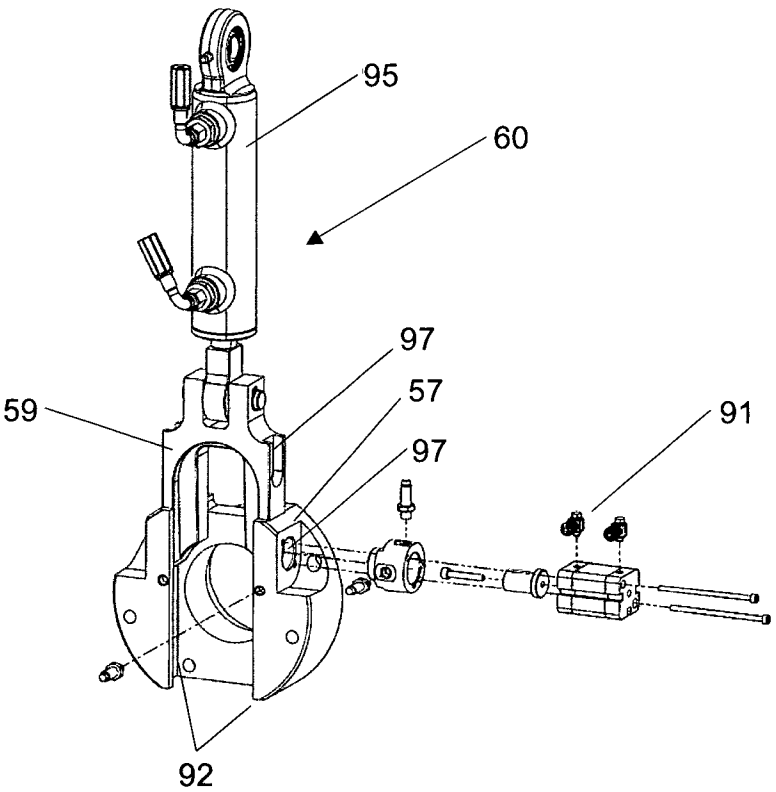
FIG. 12: an additional perspective partial exploded view of a wedge fork with hydraulic cylinder and a locking device.
Figure 11:
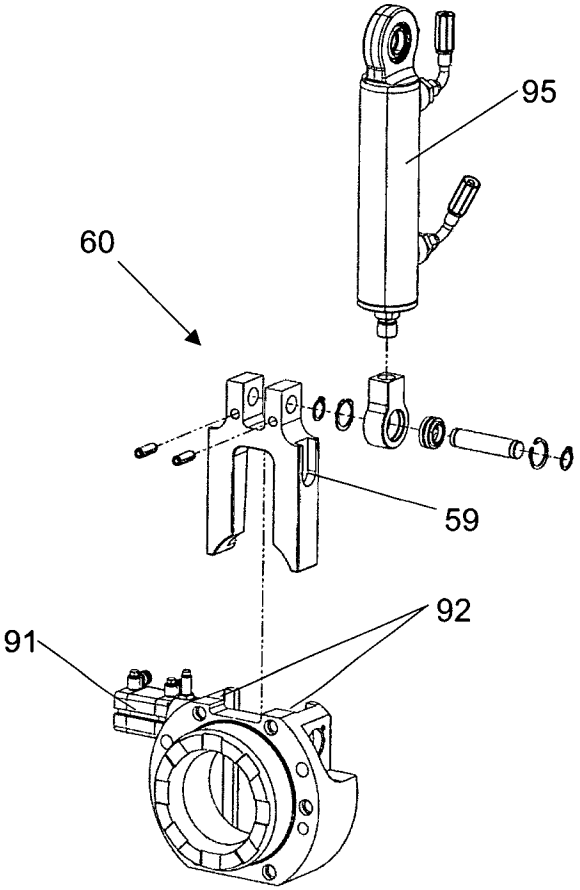
FIG. 11: a perspective partial exploded view of a wedge fork with hydraulic cylinder and a locking device.
Figure 13:
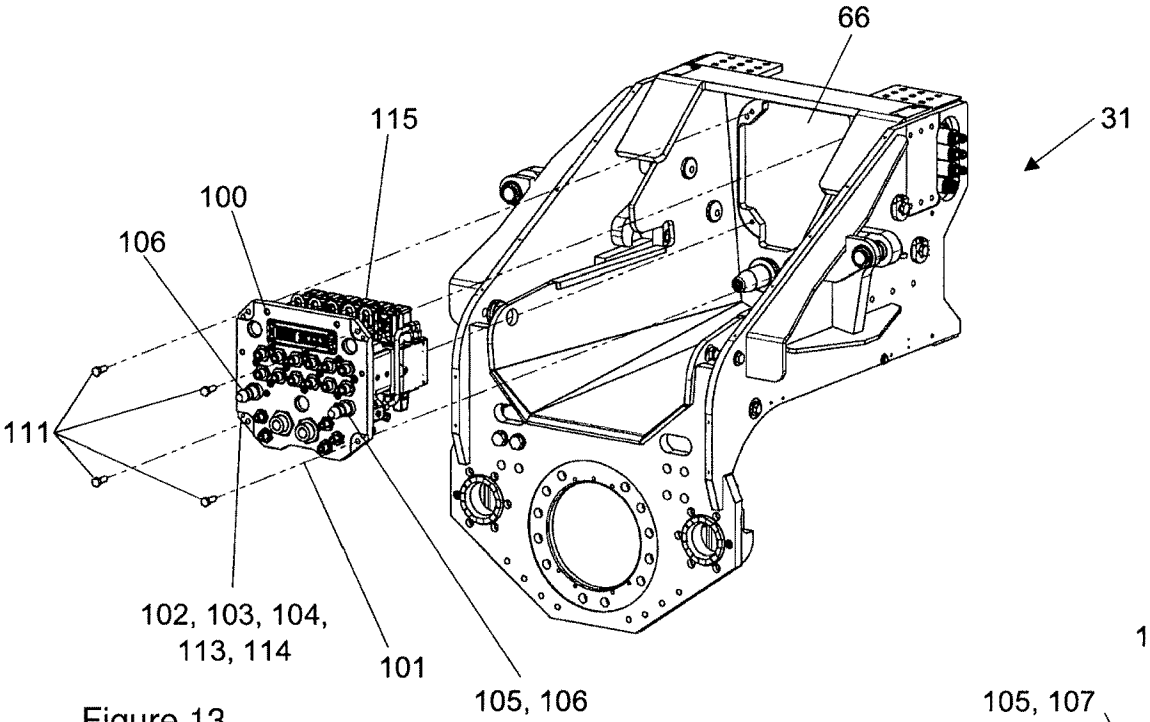
FIG. 13: a perspective explosion view of a coupling plate and a docking receiver.
Figure 14:
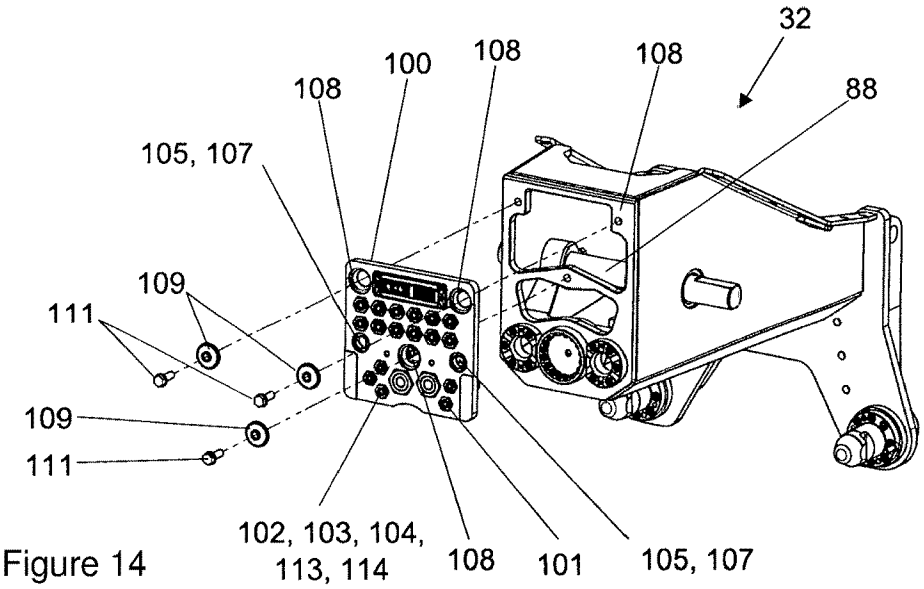
FIG. 14: a perspective explosion view of an additional coupling plate and a docking plug-in module.

An operating hydraulic pump is in Stand-By mode during the coupling process. Release A and B couplings into the tank. Stand-by pressure is applied to the Power-Beyond couplings. This is exemplified in the FIG. 2. A coupling plate 100 on the add-on unit side an electric coupling 138, an electronic coupling, a DW controller 139, a centering recess 141 and a Power-Beyond coupling 140.

A vehicle side coupling plate 100 also has the connections mentioned above. Furthermore, a valve block 137, a connection for a main supply of the operating hydraulics 143 and a supply line for the valve block 142 are provided on this coupling plate 100.

The vehicle-side coupling plate 100 consists of a pre-assembled plate in which electrical plugs, hydraulic couplings and compressed air couplings as well as centering pins for fine alignment of the counter plate on the device side are installed on the add-on side. On the vehicle side, the valve block is flanged with up to 6 double-acting hydraulic controllers. The multi-coupler is hydraulically designed in such a way that only the pressure line, tank line and load signalling lines are connected for the operating hydraulics. The lines between these main connections and the couplings of the Power-Beyond system as well as the supply to the valve block are integrated in the plate. The plate is screwed tightly with the vehicle-side docking receiver.

The coupling plate 100 on the add-on side contains the corresponding mating connectors and couplings and rests on the rear side on a flat surface on the docking plug-in unit (metal on metal). The plate is movably mounted using rubber elements on the transverse and vertical axes of the vehicle. This enables the fine centring of the plate through the holes corresponding to the centring pins on the vehicle in order to achieve the precise alignment (in the range of 0.05 mm) required for the hydraulic couplings.

According to the disclosure, a coupling plate 100 is intended to form electrical, electronic, hydraulic and/or pneumatic connections. This coupling plate 100 comprises an approximately flat base plate 101. This base plate 101 can be provided with multiple electrical, electronic, hydraulic and/or pneumatic and mechanical connecting elements.

The base plate 101 has at least two hydraulic connecting means 113. These two hydraulic connecting means 113 are designed to actuate support foot cylinders present on almost all connectable modules. In addition, at least one electronic connection means 102 for providing an electronic connection between a control unit of a vehicle and a control unit of a vehicle is provided on the base plate 101. This electronic connection is used to identify the type of module or trailer or add-on unit.

Furthermore, at least one electrical connection means 103 is arranged on the base plate 101. This electrical connection means is intended to actuate a light (e.g. brake, front, rear, position or warning light) on the extension module. Furthermore, there are two electrical control contacts 104 which are electrically connected to each other by coupling the docking plug-in module 32 with the docking receiver 31 in order to detect whether the docking plug-in module 32 is fully retracted into the docking receiver 31 and a safety and/or locking device can be activated.

In addition to the minimum connecting devices mentioned above, the coupling plate has a centring means 105. This centring means 105 comprises, if the coupling plate 100 is provided for the docking receiver 31, at least two centring pins 106, wherein the corresponding centring recesses 107 are correspondingly formed on a coupling plate of the docking plug-in module 32.

The centring means comprises at least two coupling (centring pin 106) and/or counter-coupling members (centring recess 107). Furthermore, three connecting holes 108 are provided in a coupling plate 100 for connecting the coupling plate 100 with a docking plug-in module 32 or a docking receiver 31. In these connecting bores 108, tubular plastic bushes 109 or rubber bearings are provided, can also be an elastic material, which enables a small clearance and thus increases precision when connecting two coupling plates. In corresponding recesses 110 of the plastic bushings 109, connecting means 111, such as screws, can be arranged to connect the coupling plate 100 with a coupling device, such as a docking plug-in module 32 or a docking receiver. The plastic bushes 109, in conjunction with the connecting means 111, form a bearing arrangement 112. Pneumatic connecting means 114 are also provided in the base plate 101.

Features of the coupling plate are described in detail as follows. A coupling plate 100 formed on the vehicle comprises the roughly flat base plate 101, in which electrical connecting devices 103 and/or electronic connecting devices 102, such as electric plugs 102, hydraulic connecting devices 113, such as hydraulic couplings 113, and pneumatic connecting devices 114, such as compressed-air couplings, and centring pins 106 for fine centring of the coupling plate on the attachment side are integrated.

On the vehicle side, a valve block 115 with up to six double-acting hydraulic control valves (not shown) is flange-mounted. The coupling plate 100 is hydraulically designed in such a way that only the pressure line, tank line and load signalling lines are connected for the operating hydraulics. The lines between these main connections and the couplings of the Power-Beyond system as well as the supply to the valve block 115 are integrated in the plate 101.

The base plate 101 is firmly bolted to a vehicle-side docking receiver 31 using connecting means 111. The device-side coupling plate 100 on the docking plug-in unit includes the corresponding mating plugs and couplings and is firmly connected to a docking plug-in unit 32 via the bearing arrangement 112 or the plastic bushes 109 and the connecting means 111.

The bearing arrangement 112 is thus designed to provide a slight clearance of the coupling plate in a vertical and a horizontal plane with respect to a coupling means. This enables the coupling plate 100 to be finely centred via the plastic bushes 109 or rubber bushes and the bores provided therein in relation to the vehicle-side centring pins 106 in order to achieve the precise alignment required for the hydraulic coupling in the range of 0.05 mm.

When connecting two coupling plates according to the disclosure, which are designed for connecting a vehicle with an add-on unit, the following connections are formed simultaneously when coupling:

Electrical connections (light, electrical power supply)

Electronic connections (CAN-BUS, if required ISO-BUS, Ethernet)

hydraulic connections for vehicle hydraulics and operation hydraulics up to six double-acting hydraulic controllers with a maximum flow of 100 l/minute respectively Power-Beyond connection with a maximum flow of 180 l/minute hydraulic connections for support feet on add-on unit Pressurised air supply Pressurised air brake for detachable additional axle modules and/or trailers or add-on modules.

The connection of two coupling plates 100 according to the disclosure is made by connecting a docking receiver 32 with a docking plug-in module 31. When connecting two coupling plates 100 according to the disclosure, it is thus provided that the centring pins 106 of a coupling plate 100 connected to a docking receiver 31 can penetrate into the corresponding centring recesses 105 of a coupling plate according to the disclosure connected to a docking receiver 32 and in this way precisely align the two coupling plates 100 to each other, especially in a vertical connecting plane. In this way, all electrical, electronic, hydraulic and/or pneumatic connections provided at docking plug-in module 32 and docking receiver 31 are connected to each other.

A docking receiver 31 (coupling means) of a docking device 30 (coupling device) to receive a docking plug-in module 32 (coupling means) is described below by means of an exemplary embodiment. The docking receiver 31 comprises a roughly U-shaped precentring means 33 with an insertion pan 35 roughly conically tapering in an insertion direction 34 to pre-centre a docking plug-in module 32 corresponding in design to the docking receiver.

At least a first and second centring means 36, 37 are further provided at the docking receiver 31, wherein the first and second centring means 36, 37 each comprise two coupling members and/or counter-coupling members for connecting to corresponding coupling members and/or counter-coupling members of a docking plug-in module 32. The first and second centring means 36, 37 for centring the docking plug-in module 32 with reference to the docking receiver 31 are designed along four centring axes 38 corresponding to the four coupling and counter-coupling members in the direction of insertion 34. The docking receiver 31 additionally comprises a drawing-in means with two hydraulically actuated catch hooks 44 for drawing the docking plug-in module 32 into the docking receiver 31 in the insertion direction 34.

The docking receiver 31 includes two docking walls 39, 40 extending vertically and arranged horizontally offset to each other. These two docking walls 39, 40 are connected by an insertion pan 35 extending in a roughly horizontal direction. Accordingly a first docking wall 39 is arranged vertically in the region below the insertion pan 35 and a second docking wall is arranged as a delimitation of the insertion pan 35 in a horizontal direction above the insertion pan 35.

The insertion pan assumes the function of pre-centring when a docking plug-in module is inserted into the docking receiver by receiving a body of the docking plug-in module 32 designed to correspond with the insertion pan 35. To pre-centre the docking plug-in module 32 when it is inserted in the docking receiver 31 the geometry of the insertion pan 35 tapers in the insertion direction 34 to allow pre-centring of the docking plug-in module.

On both sides of the insertion pan 35 roughly transversely to the insertion direction 34 provision is made for internal and external side walls 41, 42 extending roughly vertically. These internal and external side walls 41, 42 are arranged at a predetermined angle in the insertion direction 34 in such a manner that a receiving space 43, limited by the internal side walls 41 and the insertion pan 35, tapers in the insertion direction. In the internal side walls 41 catch pin guides 45 are provided to guide and receive corresponding formed catch pins on a docking plug-in module 32. In the internal and external side walls 41, 42 shafts on which the catch hooks 44 are pivoted are arranged in corresponding drillings. The catch hooks are therefore arranged in a catch hook space delimited by the internal and external side walls. The catch hooks can be activated by corresponding catch hook cylinders 46.

In the region of the first docking wall 39 are provided roughly sleeve-form centring pin receivers 47 (counter-coupling members), which form the first centring means 36 of the docking receiver 31. In the insertion direction 34 is firstly provided the first docking wall 39, which has two drillings 48 to receive the sleeve-form centring pin receivers 47.

The sleeve-form centring pin receivers 47 are arranged in the holes 48. The sleeve-form centring pin receivers 47 are therefore arranged in the insertion direction 34 behind the first docking wall 39. In the insertion direction 34 the sleeve-form centring pin receivers 47 comprise a tubular insertion/centring section 49 and a securing section 54.

The tubular insertion/centring section 49 has a conically tapering insertion recess 50, wherein a vertical end face arranged against the insertion direction 34 projects from the first docking wall 39 and forms a first axial stop face 51 of a first stop device 52. In this circular first stop face 51 are formed radially-running and equally spaced debris discharge slots 53 to receive and remove contaminants. Such contaminant would alter the position of the stop. This is disadvantageous in that an exact coupling is not possible between docking receiver and docking means.

The tubular insertion/centring section 49 has a cylindrical centring recess 55 connecting in the insertion direction 34 to the insertion recess. On a circular end face positioned against the insertion direction 34 the tubular securing section 57 has drillings 56 to connect with the first docking wall 39, for example by means of appropriate bolted connections. This end face has a larger diameter than the tubular insertion/centring section 49, thereby forming a radially-running stop shoulder which prevents movement of the sleeve-form centring recess against the insertion direction 34. The advantage of this design is that the longitudinal force firstly applied by add-on units and secondly overlaid by the wedge force of the wedge forks, need not be introduced into the docking recess by way of a screw assembly.

Furthermore, in the tubular securing section 57 are present vertically extending slots 58 to receive hydraulically actuated wedge forks 59. The wedge forks 59 are provided for fixing a corresponding centring pin of a docking plug-in module 32 and are vertically movable from a release position to a fixing position. The wedge forks 59 therefore form an axial securing means 60.

In roughly the centre of the first docking wall 39 is provided a drive shaft connection means in the region between the two sleeve-form centring pin receivers 47. A drive shaft connection means 67 is part of a drive shaft connection device for connecting the onboard end of a drive shaft with the end of a drive shaft on the add-on unit. In the second docking wall 40 a recess 66 is formed to receive a coupling plate for the provision of electric, electronic, hydraulic and/or pneumatic connections between a vehicle and an add-on unit. The coupling plate with a flange-mounted valve block can be disassembled very quickly and easily for repair purposes by loosening only four bolts against the insertion direction 34.

Furthermore, in the region of the second docking wall 40 two centring pins 61 (coupling members) are provided which extend against the insertion direction 34, which form the second centring means 37 of the docking receiver 31. In the insertion direction 34*b* the centring pins 61 have a conical insertion section 62 and a cylindrical centring section 63 connected thereto. A circular vertical end face positioned at the front in the insertion direction 34 connecting to the centring section 63 forms a second stop face 64 of a second stop device 65.

The coupling members and/or the counter-coupling members of the first and second centring means thus form at least two axial stop device which limit relative movement between docking receiver and docking plug-in module in the insertion direction. The stops are preferably formed as circular stop faces on the first and/or second centring pin and/or the first or second centring recess extending in a plane vertical to the insertion direction.

Roughly in the centre of the second docking wall 40 a power take-off shaft connection means 68 is provided in the region between the two centring pins 66. A power take-off shaft connection means 68 is part of a power take-off shaft connection device for connecting the on-board end of a power take-off shaft with the end of a power take-off shaft on the add-on unit.

The docking receiver is positioned above a large machined drilling approx. 258 mm in diameter in the first plate on a centring spigot on a central pipe flange of an axle centre section. This precision makes it possible to use a connecting shaft with toothed sleeves for connecting the power take-off shaft drive of the gearbox and the power take-off shaft connection means. This obviates the need for a connection using a cardan shaft, which is expensive and, above all, not maintenance-free.

In the following, the docking plug-in module 32 according to the disclosure is described as an example. The docking plug-in module 32 is designed to correspond to docking receiver 31. The docking plug-in module 32 features a first docking wall 70 in the insertion direction 34. The first docking wall 70 extends essentially in a vertical direction and has a bottom wall 89 on the underside corresponding to the insertion pan 35 of the docking receiver 31. Furthermore, a drive shaft connecting means is provided approximately in the middle of the first docking wall 70.

Corresponding to the centring pin receivers 47 of the first centring means 36 of the docking receiver 31, first centring pins 71 of a first centring means 72 of the docking plug-in module 32 are formed on the first docking wall 70 of the docking plug-in unit 31 and extend in the insertion direction 34. In the insertion direction 34 the first centring pins 71 have a cylindrical insertion section 73 and a conical centring section 74 connected thereto.

Furthermore, the first centring pins 71 have circular first stop surfaces 93 against the direction of insertion, which form a first stop device 94 of the first centring means 72. In the cylindrical centring section 73, vertically extending wedge fork mounting groove 74 are provided which correspond to the wedge forks 59. An insertion body 75 extending in the direction of insertion is provided on the first docking wall for arrangement in the receiving space 43 of the docking receiver 31. In the front direction of insertion, the insertion body 75 has an approximately vertically extending second docking wall 76.

In the second docking wall, corresponding to the second centring pins 61 of the second centring means 37 of the docking receiver 31, corresponding centring pin receiver 77 of a second centring means 78 of the docking plug-in module 32 are formed. The second docking wall 76 features two holes 80 for the sleeve-form centring pin 77. The sleeve-form centring pin receivers 77 are arranged in the holes 80. The sleeve-form centring pin receivers 77 comprise a centring section 82 and an insertion section 81 in the insertion direction 34.

The tubular insertion section 81 has a conically tapering insertion recess 83, wherein an end face arranged against the insertion direction 34 projects from the second docking wall 76 and forms a second axial stop face 84 of a second stop device 85. In this circular second stop face 85 radially-running and equally spaced debris discharge slots 86 are provided to receive and remove contaminants. The tubular centring section 82 has a cylindrical centring recess 87 connected to the insertion recess 83 in the direction opposite the insertion direction 34. In the area between these centring pin recesses 77 a power take-off connecting means is arranged. In the vertical section above the second centring means 78 a coupling plate receiver is formed.

Furthermore, catch pin shaft 88 extending transversely to the insertion direction 34 is arranged on the insertion body 75. The ends of the shaft form the catch pins 89. These catch pins 89 are grasped by the catch hooks 44 of the docking receiver 31 when the docking plug-in module 32 is inserted into the docking receiver 31 and then the docking plugin module 32 is pulled into the docking receiver 32 by means of the hydraulically operated catch hooks 44, wherein a bottom wall 90 of the insertion body 75 of the docking plug-in module 32 slides correspondingly in the insertion pan 35 of the docking receiver 31.

In addition to axial locking as a safety means 60, the hydraulic wedge forks also have a second locking device extending transverse to the insertion direction. The second locking means comprises a pneumatically operated arrestor body, which fixes the wedge forks in the centring pin bushes. This second locking is possible only if the hydraulic wedge fork is correctly positioned. Accordingly, a sensor is provided to check the position of the hydraulic wedge fork. Wedge forks have the advantage that they can be easily automated. The wedge forks are guided in the wedge fork grooves at all times.

In an alternative embodiment, provisions can also be made so that the centring devices or their centring elements (pins, bushings) are interchanged. The only decisive factor here is that both the two centring pins, or centring recesses, of the first and second centring devices are designed in such a way that all four components enable simultaneous centring, since an add-on unit arranged on the docking plug-in module are often heavy and accordingly precise centring in the axial insertion direction is necessary.

A procedure for docking or inserting the docking plug-in module into the docking receiver or a procedure for connecting a docking plug-in module to a docking receiver is described below. First, the insertion body 75 of the docking plug-in module is positioned in the area of the receiving space 43 of the docking receiver 31, preferably by moving the vehicle and thus the docking receiver 31 positioned thereon. The docking plug-in module is pre-centred in the docking receiver by sliding the bottom or insertion wall 90 of the docking unit 32 in the insertion pan 35 of the docking receiver 31.

After a relative movement has taken place in the direction of insertion over a predetermined length, the catch hooks 44 of the docking receiver are actuated by means of the catch hook cylinders 46 and are first lowered vertically downwards so that catch recesses 69 of the catch hooks 44 engage behind the catch pins 89 of the docking station. To do this, the vehicle hydraulic circuit is used while the Power-Beyond coupling or the operating hydraulic circuit is on stand-by.

Moving the docking plug-in module into the docking station is therefore initially done by moving the vehicle. Thereby a pre-centring is carried out. The catch hooks then engage and pull the docking plug-in module into the docking receiver in the direction of insertion.

Two rollers, which are rotatably mounted in the docking receiver, form a link guide with a slot in the catch hook and a track on the upper side of the catch hook. This link guide causes the catch hooks to move first in the longitudinal direction of the vehicle and then upwards when extended. This causes an opening into which the catch pins are inserted when entering the docking plug-in module. On pulling the catch hooks, the hooks first move down and interlock with the catch pins. The docking plug-in module is then retracted. The catch pins then slide along a catch pin guide 45 in the inner side walls 41 of the docking receiver 31, wherein the catch pins 89 are arranged in the catch pin guide 45 with only slight clearance.

A further movement of the docking plug-in module 31 in the direction of insertion 34 then causes a further centring of the docking plug-in module 32 in the docking receiver 31 via the first and second centring devices 36, 37, 72, 78 of the docking receiver 31 and the docking plug-in module 32 along the four centring axes 38. Thereby, the two centring pins 71 of the first centring means 72 of the docking plug-in module 32 slide with their conical insertion sections 74 into the conical insertion openings 50 of the two centring pin holders 47 of the first centring means 36 of the docking plug-in module 31. At the same time, the conical surfaces of the insertion sections 62 of the centring pins 61 of the second centring means 37 of the docking receiver 31 slide into the insertion recesses 83 of the centring pin receivers 77 of the second centring means 78 of the docking plug-in module.

A further movement of the docking plug-in module 31 in the insertion direction 34 then results in a further fine centring of the docking plug-in module 32 in the docking receiver 31. Thereby, the two centring pins 71 of the first centring means 72 of the docking plug-in module 32 slide with their cylindrical insertion sections 73 into the cylindrical centring recesses 55 of the two centring pin holders 47 of the first centring means 36 of the docking plug-in module 31. At the same time, the cylindrical centring sections 63 of the centring pins 61 of the second centring means 37 of the docking receiver 31 slide into the centring recesses 87 of the centring pin receivers 77 of the second centring means 78 of the docking plug-in module. The movement of the docking plug-in module 32 in insertion direction 34 towards the docking receiver 31 is limited by the first stop surfaces 51, 93 of the first stop devices 52, 94 of the first centring means 36, 72. Moreover, the movement of the docking plugin module 32 in insertion direction 34 towards the docking receiver 31 is limited by the second stop surfaces 64, 84 of the second stop devices 65, 85 of the first centring means 36, 72.

As soon as the stop surfaces 51, 93 of the first stop devices 52, 94 and the stop surfaces 64, 84 of the second stop device 65, 85 are in contact with each other, the insertion of the docking plug-in module 32 into the docking receiver 31 is limited in axial direction. The docking plug-in module 32 is fully inserted in the docking receiver 31. Preferably, both the docking plug-in module 32 and the docking receiver 31 are provided with electrical contacts (not shown) that contact each other once the docking process is completed. A signal generated in this way is used to shift the actuating cylinders 95 of the hydraulically actuated wedge forks 59 vertically downwards in such a way that forks of the wedge forks 59 engage in the grooves 58 of the securing section 57 of the first centring pins 71 of the first centring means 72 of the docking plug-in module and, in addition to the catch hooks 44, prevent the docking plug-in module 32 from being uncoupled from the docking receiver 31.

To secure the wedge forks, a pneumatically actuated locking device 91 is provided, which attaches corresponding locking pins 96 through locking holes 97 formed in the securing section 57 and in the forks of the wedge fork 59, thus fixing and securing the position of the wedge forks 59. At the same time, power take-off shaft connecting means and/or drive shaft connecting devices of the docking receiver 31 and the docking plug-in module 32 may be connected to each other in this end position.

LIST OF REFERENCE NUMERALS

30 docking device
31 docking receiver
32 docking plug-in module
33 pre-centring means
34 insertion direction
35 insertion pan
36 first centring means
37 second centring means
38 centring axis
39 first docking wall
40 second docking wall
41 internal side wall
42 external side wall
43 receiving space
44 catch hook
45 catch pin guide
46 catch hook cylinder
47 centring pin receiver
48 drilling
49 insertion/centring section
50 conical insertion opening
51 first axial stop face
52 first stop device
53 debris discharge slots
54 tubular centring section
55 cylindrical centring recess
56 drilling
57 securing section
58 slots
59 wedge fork

60 axial securing device
61 centring pin
62 insertion section
63 centring section
64 second stop face
65 second stop device
66 recess
67 drive shaft connecting means
68 power take-off shaft connecting means
69 catch recesses
70 first docking wall
71 first centring pin
72 first centring means
73 cylindrical centring section
74 Wedge fork mounting groove
75 insertion body
76 second docking wall
77 centring pin receiver
78 second centring means
79 coupling plate receiver
80 drilling
81 securing section
82 centring section
83 insertion recess
84 second stop face
85 second stop device
86 Dirt discharge groove
87 centring recess
88 catch pin shaft
89 catch pin
90 Bottom wall
91 Locking device
92 Wedge fork mounting groove
93 first stop face
94 first stop device
95 operating cylinder wedge fork
96 locking pins
97 locking hole
100 coupling plate
101 base plate
102 electronic connecting means
103 electrical connecting means
104 electrical control contact
105 centring means
106 centring pin
107 centring recess
108 connection hole
109 plastic sleeve
110 recess
111 connecting means
112 bearing arrangement
113 hydraulic connecting means
114 pneumatic connecting means
115 valve block
120 hydraulic system
121 operating hydraulic circuit
122 vehicle hydraulic circuit
123 coupling sleeve
124 coupling sleeve on Power-Beyond connection
125 coupling connector
126 operating hydraulic control circuit
127 coupling connector
128 lines
129 operating hydraulic pump
130 Crankshaft
131 engine
132 load signaling controller
133 load signaling line
135 vehicle hydraulic pump
137 valve block
138 electro-coupling 138
139 one coupling DW controller
140 Power-Beyond coupling
141 centring recess
143 Connection for a main supply of the operating hydraulic
142 Supply lines for the valve block

The invention claimed is:

1. A hydraulic system (120) for a vehicle comprising:

a vehicle hydraulic circuit (122) among others for hydraulically supply to connecting means of an automatic coupling device, wherein the connecting means is designed in such a way as to connect a coupling means (31) of a vehicle with a correspondingly formed coupling means (32) of an add-on unit, the vehicle hydraulic circuit (122) including a first pump, the vehicle hydraulic pump (135); and an operating hydraulic circuit (121) for supplying at least one Power-Beyond coupling, the operating hydraulic circuit (121) including a second pump, the operating hydraulic pump (129), which is in Stand-By mode during the coupling operation;

the vehicle hydraulic circuit (122) and the operating hydraulic circuit (121) being formed independent of each other.

2. The hydraulic system (120) of claim 1, wherein the connecting means are a docking receiver (31) and a docking plug-in module (32), the docking receiver (31) being arranged on the vehicle or on the add-on unit and the docking plug-in module (32) being arranged on the add-on unit or on the vehicle, wherein the docking receiver (31) and the docking plug-in module (32) work together for coupling the vehicle with an add-on unit, wherein coupling sleeves (123) of the operating hydraulic control circuit of the add-on unit and coupling sleeves (124) of the PowerBeyond connection of the add-on unit are arranged on the docking plug-in module (32).

3. The hydraulic system (120) of claim 2, wherein the docking receiver (31) or the docking plugin module (32) of the vehicle have corresponding coupling connectors (125) of an operating control hydraulic circuit (126) of the vehicle which are coupled to a valve block (115).

4. The hydraulic system (120) of claim 1, further comprising a coupling connector (127) for the Power-Beyond connection are provided on a docking receiver (31), the coupling connector (127) for the power beyond connection being connected via lines (128) to a variable displacement pump of the hydraulic circuit or an operating hydraulic pump (129).

5. The hydraulic system (120) of claim 1, wherein the operating hydraulic pump (129) is inseparably connected to a crankshaft (130) of an engine (131) and is supplied with the energy necessary for operation.

6. The hydraulic system (120) of claim 1, wherein the operating hydraulic pump (129) is controlled by a load signaling controller (132) via a corresponding load signaling line (133).

7. The hydraulic system (120) of claim 1, wherein the vehicle hydraulic circuit (122) comprises a vehicle hydraulic pump (135) which is designed as a variable displacement pump and is connected via a load signaling line (136) to a valve block (137) of a docking system, the vehicle hydraulic pump (135) being inseparably connected to the coupling shaft (130) of the engine (131) and is supplied by the latter with the energy required for operation.

8. The hydraulic system (120) of claim 1, wherein the vehicle hydraulic pump (135) is connected via at least one hydraulic line to a valve block for actuating cylinders for feed hooks or catch hooks of a docking receiver (31) in a locking device.

9. A vehicle with a hydraulic system (120) according to claim 1, wherein a coupling means (31) for connecting the vehicle to a correspondingly designed coupling means (32) of an add-on is provided, and a vehicle hydraulic circuit (122) for hydraulic supply to the connecting means, wherein the connecting means is designed in such a way that it can connect a coupling means (31) of a vehicle with a correspondingly formed coupling means (32) of an add-on unit, and an operating hydraulic circuit (121) for supplying at least one Power-Beyond coupling, the vehicle hydraulic circuit (122) and the operating hydraulic circuit (121) being independent of each other and each having a hydraulic pump.

10. A method for operating a hydraulic system (120) for a vehicle, comprising:

providing a connecting means (131, 132) of an automatic coupling means hydraulically supplied by a vehicle hydraulic circuit (122), wherein the connecting means of a coupling means (31) of a vehicle can be automatically connected to correspondingly formed coupling means (32) of an add-on unit, wherein an operating hydraulic circuit (121) is used to supply at least one Power-Beyond coupling, and wherein the vehicle hydraulic circuit (122) includes a first pump, the vehicle hydraulic pump (135) and the operating hydraulic circuit (121) includes a second pump, the operating pump (129), which is Stand-By mode during the coupling operation, with the vehicle hydraulic circuit (122) and operating hydraulic circuit (121) designed independent of each other.

11. The method of claim 10, further comprising coupling a vehicle with a corresponding add-on unit, wherein the Power-Beyond coupling is depressurized with a stand-by pressure.

12. The method of claim 10, wherein the operating hydraulic pump is in Stand-By mode during the coupling operation.

13. The method of claim 10, wherein the supply to a feed hook and a catch hook of the coupling means and a locking takes place via the vehicle hydraulic pump (135).

14. The method of claim 10, wherein the vehicle hydraulic system additionally supplies to a hydro pneumatic suspension and an axle steering, including a rear axle steering.

* * * * *